US008480443B2

(12) United States Patent
Talos

(10) Patent No.: US 8,480,443 B2
(45) Date of Patent: Jul. 9, 2013

(54) ALL SEASON AIR PROPELLED WATERCRAFT

(76) Inventor: Teofil Talos, St-Leonard (CA)

( * ) Notice: Subject to any disclaimer, the term of this patent is extended or adjusted under 35 U.S.C. 154(b) by 226 days.

(21) Appl. No.: 13/092,930

(22) Filed: Apr. 23, 2011

(65) Prior Publication Data

US 2011/0263166 A1 Oct. 27, 2011

Related U.S. Application Data

(60) Provisional application No. 61/282,940, filed on Apr. 27, 2010.

(51) Int. Cl.
*B63H 7/02* (2006.01)

(52) U.S. Cl.
USPC ..... 440/37; 244/101; 244/105

(58) Field of Classification Search
USPC ..... 114/272, 273, 282, 283; 244/101, 244/105; 440/37
See application file for complete search history.

(56) References Cited

U.S. PATENT DOCUMENTS

| | | | | |
|---|---|---|---|---|
| 1,678,023 | A | | 7/1928 | Stites |
| 1,709,219 | A | | 4/1929 | Hille |
| 1,710,625 | A | | 4/1929 | Kapigian |
| 1,816,118 | A | * | 7/1931 | Knight ..... 440/37 |
| 1,846,602 | A | | 2/1932 | Lake |
| 2,678,018 | A | | 5/1954 | Crisp |
| 3,172,134 | A | | 3/1965 | Livingstone |
| 3,541,987 | A | | 11/1970 | Barkley |
| 3,599,903 | A | * | 8/1971 | Handler ..... 244/105 |
| 3,604,382 | A | | 9/1971 | Sorrenti |
| 3,702,106 | A | | 11/1972 | Wilder |
| 3,800,724 | A | | 4/1974 | Tracy |
| 4,080,922 | A | | 3/1978 | Brubaker |
| 4,452,166 | A | | 6/1984 | Daniel |
| 4,685,641 | A | * | 8/1987 | Kirsch et al. ..... 244/105 |
| 4,926,773 | A | | 5/1990 | Manor |
| 6,571,722 | B2 | | 6/2003 | Motsenbocker et al. |

FOREIGN PATENT DOCUMENTS

| | | |
|---|---|---|
| FR | 1505692 | 11/1967 |
| FR | 2800348 | 5/2001 |
| GB | 518878 | 3/1940 |

* cited by examiner

*Primary Examiner* — Lars A Olson

(57) ABSTRACT

An all season air propelled watercraft has an elongated cabin structure adapted to accommodate at least one person therein. An elongated central pontoon member adjustably mounted to a bottom portion of the cabin structure and extending in a parallel direction thereto for at least the length thereof. Two stabilizer connector assemblies adjustably attached to a bottom portion of the cabin structure and extending horizontally in opposite directions therefrom. Two lateral stabilizer pontoons respectively and adjustably attached to a distal end portion of each the stabilizer connector assembly.

9 Claims, 3 Drawing Sheets

ALL SEASON AIR PROPELLED WATERCRAFT

This application claims priority based on provisional No. 61/282,940 filed Apr. 27, 2010.

FIELD OF THE INVENTION

The present invention relates generally to a watercraft, but more particularly to an all season air propelled watercraft.

BACKGROUND OF THE INVENTION

Various types of watercraft are well known in the art. Typically, such watercraft are water propelled in that a rotor or propeller providing propulsion is submerged under the water and propels the watercraft forward with a portion of the bottom of the watercraft generally below the surface Unfortunately, due to the resistance provided by the water to the propeller, such watercraft consume significant amounts of fuel, thus increasing costs of operation. Further, where fossil fuels are used to power the propeller, such water propelled watercraft contribute to global warming and other forms of environmental degradation.

Additionally, the resistance provided by the water to the propeller significantly slows the watercraft. Additionally, such conventional watercraft often encounter substantial difficulties when the surface of the water is frozen, as the watercraft must break the ice to navigate therethrough. The need to break the ice slows the watercraft and requires additional energy, thus increasing still further the amount of fuel or energy consumed. Further, the ice may cause damage to the bottom of the watercraft or the propeller as the watercraft breaks through it. Accordingly, there is a need for an improved, all season air propelled watercraft.

SUMMARY OF THE INVENTION

In view of the foregoing disadvantages inherent in the known devices now present in the prior art, the present invention, which will be described subsequently in greater detail, is to provide objects and advantages which are:

To provide for an improved all season air propelled watercraft which can be easily used in all seasons, both when the surface of the water is liquid or frozen into ice.

Another advantage of this invention is that the watercraft is fuel and energy efficient.

Still another advantage of the present invention is watercraft provides enhanced, and adjustable, stability and buoyancy.

A further advantage of the present invention is that the watercraft is capable of traveling at higher speeds than conventional watercraft.

In order to do so, the watercraft has an elongated cabin structure adapted to accommodate at least one person therein. An elongated central pontoon member adjustably mounted to a bottom portion of the cabin structure and extending in a parallel direction thereto for at least the length thereof; two stabilizer connector assemblies adjustably attached to a bottom portion of the cabin structure and extending horizontally in opposite directions therefrom. Two lateral stabilizer pontoons respectively and adjustably attached to a distal end portion of each the stabilizer connector assembly; a motorized propeller attached to one end of the cabin structure; a steering mechanism within the cabin structure including a steering wheel that is mechanically attached to at least one rudder mechanism attached to an end of the cabin structure opposite the end having the propeller wherein the central pontoon member is adapted to float upon the surface of and extend into a portion of a body of water when the watercraft is in use, and wherein the two lateral stabilizer pontoons are adjustable to be either in contact with the body of water or retracted upwards and away from contacting the body of water when the watercraft is in use, such that the central pontoon member and the two lateral stabilizer pontoons are used to stabilize, control, and aid in the displacement and movement of the watercraft during use.

The air propelled watercraft has the elongated central pontoon member being buoyant and include laterally extending top, side, and bottom portions, wherein the bottom portion includes a central blade extending a portion of its length and functions to increase the stability of the watercraft in water and to provide a sliding surface to the watercraft when the watercraft is placed upon a frozen portion of the body of water.

The air propelled watercraft has the side portions of the elongated central pontoon member tapered along a portion of its length and in a direction from the top portion to bottom portion thereby forming the central blade and increasing the stability and speed of the watercraft.

The air propelled watercraft has the side portions of the central blade taper towards one another and away from one another in predetermined sections along its length to increase stability and reduce surface drag; and wherein the blade slants upwardly at a front end thereof forming a point with the side and top portions, such that when the watercraft is moving through the body of water, the front end breaks through the water more efficiently and provides further stability to the watercraft.

The air propelled watercraft has each of the two stabilizer pontoons pivotally connected to respective the distal end portion of each the stabilizer connector assembly by stabilizer connector arms, to thereby provide for a raised configuration wherein the pontoons are out of the water, and a lowered configuration wherein the pontoons are in the water and are in vertical alignment and slightly vertically above the central blade.

The air propelled watercraft has each of the two stabilizer pontoons having opposed side portions that curve inwardly from a top portion thereof forming respective pontoon blades on a portion of the length of a bottom portion thereof, thereby further increasing the stability of the watercraft.

The air propelled watercraft has each the stabilizer connector assembly include a pair of parallel lateral connector arms spaced from one another, and an end bar extending between and connecting distal end portions of each lateral connector arm.

The air propelled watercraft has each the stabilizer connector assembly further include at least one intermediate stabilizer arm connected diagonally between the lateral connector arms to further increase the strength thereof.

The air propelled watercraft further comprises a stabilizer pontoon control mechanism including a pivotally mounted lever within the cabin structure and adapted to be manipulated by the at least one person. A lever connector cable connecting the lever to a rotatably mounted member; the rotatably mounted member connected to each the stabilizer connector assembly by respective stabilizer cables, such that when the lever is pulled in one direction the stabilizer pontoons are raised out of the water, and when the lever is pulled in an opposite direction the stabilizer pontoons are lowered into the water.

The air propelled watercraft has the steering mechanism further include a second rudder mechanism attached to an end of the central pontoon member residing in proximity to and coinciding with the rudder mechanism on the end of the cabin structure opposite the end having the propeller; wherein the both rudder mechanisms are connected with one another by a rudder rod and respective rudder cross bars, and both controlled in unison by a plurality of steering cables connecting the rudders to a steering shaft and to the steering wheel.

The air propelled watercraft has the cabin structure include at least one window. The top and side portions thereof are tapered along portions of its length thereby improving the aerodynamic qualities of the watercraft.

The air propelled watercraft further comprises at least one securing cable between the cabin structure and the central pontoon. The at least one securing cable including one securing cable connected between a front portion of the cabin structure and a back portion of the central pontoon.

The air propelled watercraft has the adjustably mounted connection between the pontoon member and the cabin structure include at least one elongated telescoping shock absorber member.

The air propelled watercraft has the at least one elongated telescoping shock absorber member being a pneumatic shock absorber.

The air propelled watercraft has the at least one elongated telescoping shock absorber member being a hydraulic shock absorber.

The air propelled watercraft where there are three elongated telescoping shock absorber members separated along the length of the central pontoon member.

The air propelled watercraft has the stabilizer pontoon control mechanism further include retaining box member having a plurality of notches therein, wherein the notches are adapted to receive the lever in one of several positions corresponding to different positions of the stabilizing pontoons and securely hold the stabilizing pontoons in a chosen position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. For example, the propeller can be located at the rear of the watercraft instead of at the front. The main cabin and pontoon can be integrated. The size and shape of the pontoon and blades can vary. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
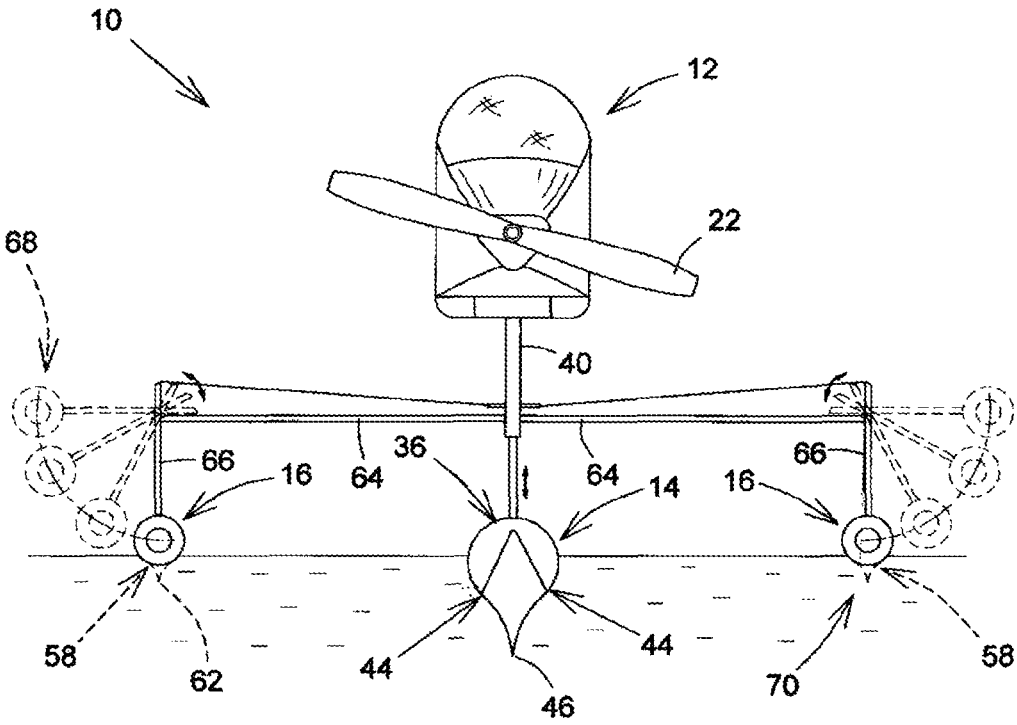
FIG. 1 Front plan view of the invention.

A watercraft (10) includes a cabin (12) mounted on a central pontoon (14) and two lateral stabilizer pontoons (16). The cabin (12) extends longitudinally from a front, first cabin end (18) to a longitudinally opposed second cabin end (20), and is sized and shaped to hold at least one person. A motorized propeller (22) connected to a motor (24) at the first cabin end (18) provides air propulsion to the watercraft (10), and thus avoids the need for water propellers and enables easy propulsion in water and on ice.

Figure 2:
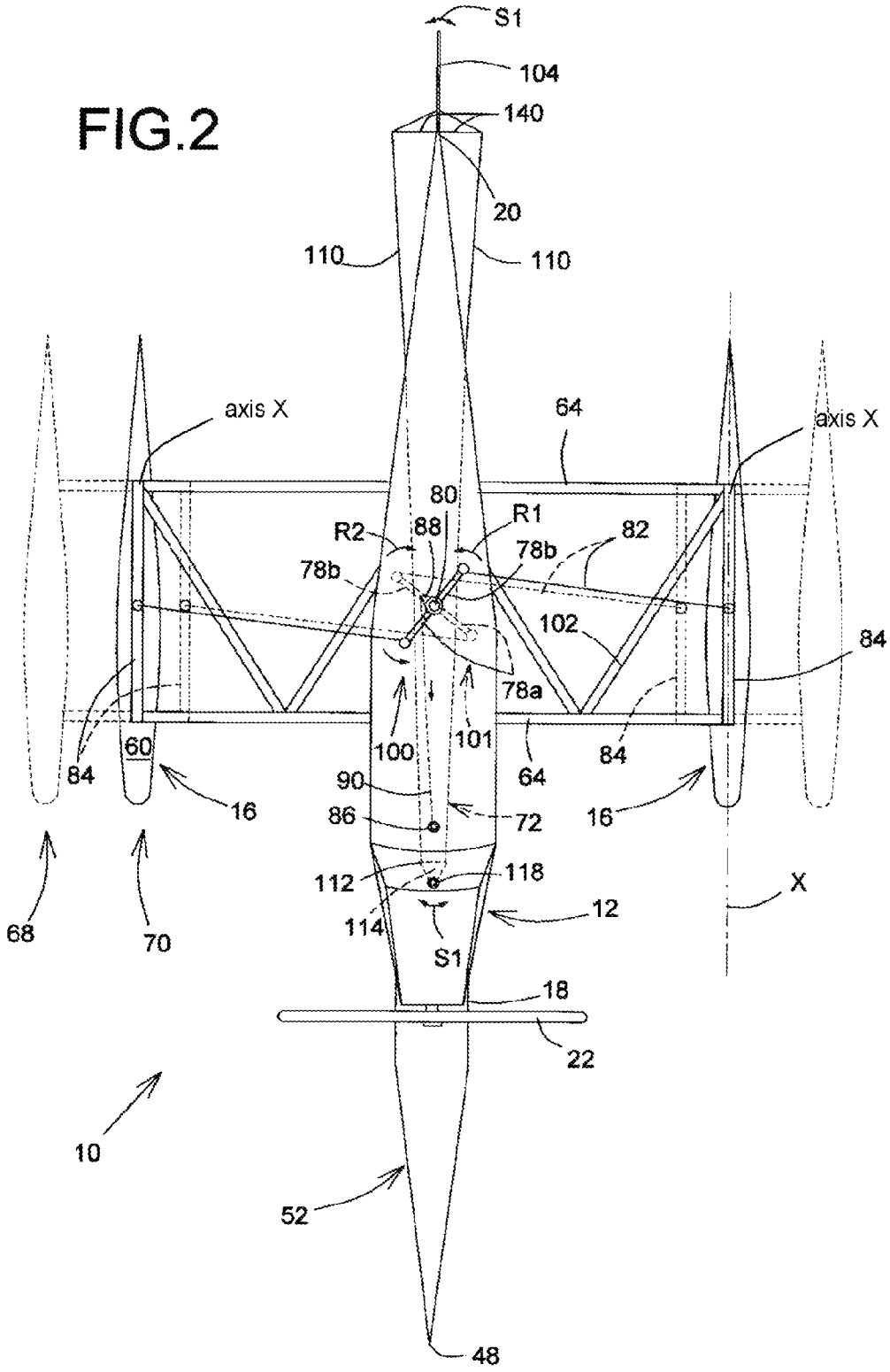
FIG. 2 Top plan view of the invention.
Figure 3:
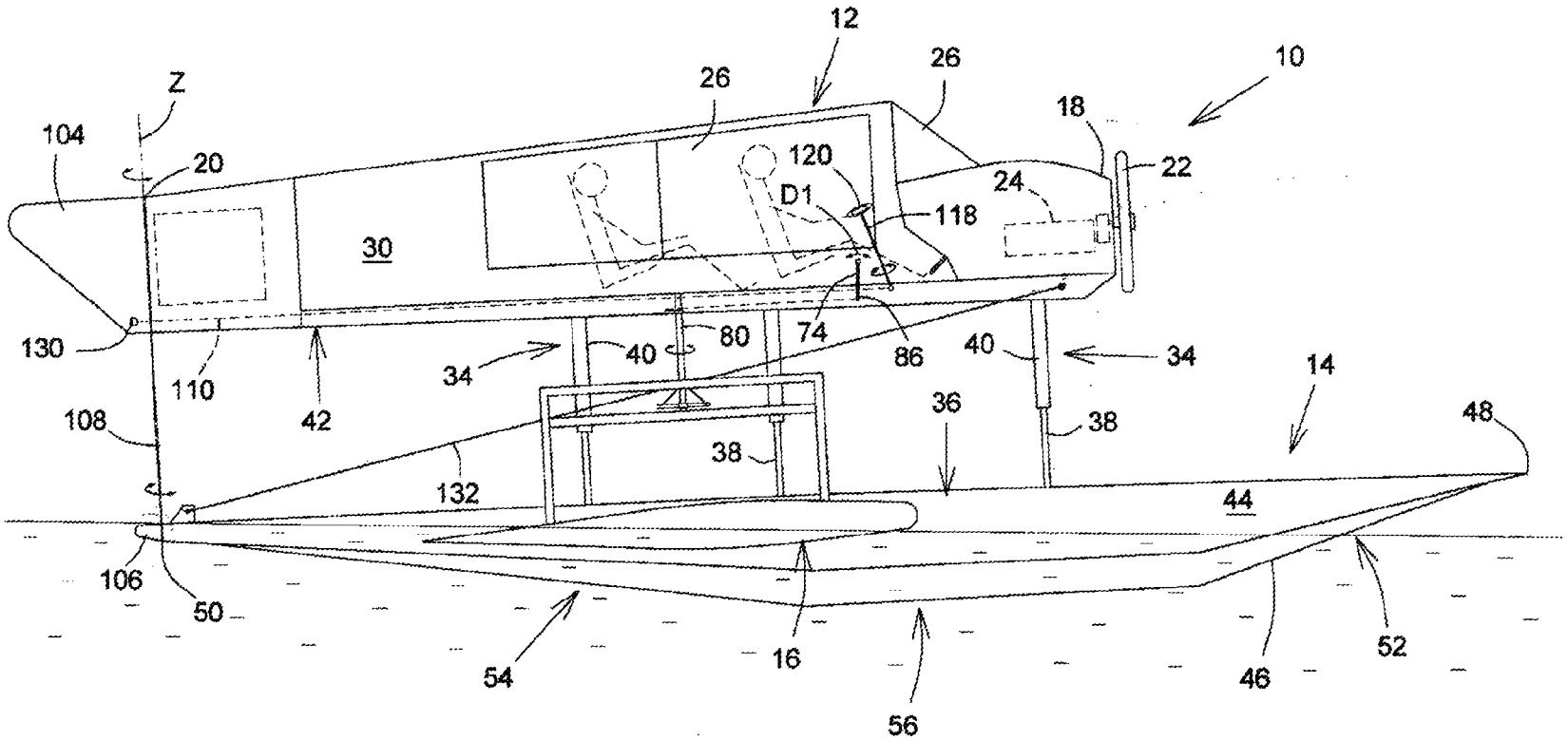
FIG. 3 Side perspective view of the invention.

As the air propeller (22) operates in air, as opposed to water, there is less resistance for the air propeller (22) as proposed to conventional watercraft. Thus, the watercraft (10) uses less energy and fuel than conventional watercraft, reducing cost, pollution, and contribution to global warming. At the same time, speed of the watercraft (10) is increased. As shown in FIGS. 1 and 2, the cabin (12) provides windows (26) proximal the first cabin end (18) and on first and second cabin sides (30), extending longitudinally between cabin ends (18, 20) to provide visibility. The cabin sides (30) may taper inwardly towards one another towards the second cabin end (20) to provide more aerodynamic shape for the cabin (12) and increase efficiency.

The, preferably hollow, central pontoon (14), is buoyant in water and extends longitudinally between first and second generally opposed first and second extremities (48, 50), having sides (44), top portion (36), and central blade (46) extending therebetween. The first extremity (48) is disposed proximal the first cabin end (18), with a front portion (52) of the central pontoon (14) preferably extending outwardly beyond the first cabin end (18). The cabin (12) is mounted to the top portion or surface (36) by at least two central suspension legs (34) which preferably provide pneumatic or hydraulic suspension and shock absorption.

More specifically, each central suspension leg (34) preferably has a pneumatic or hydraulic piston cylinder combination, i.e. a lower piston (38) connected to the pontoon (14) and telescopically and resiliently mounted in an upper hydraulic or pneumatic cylinder (40) connected to the cabin bottom (42). Thus, the pistons (38) may extend and retract, providing shock absorption and stability for the watercraft (10), and in particular the cabin (12) in response to waves, bumps, or other shocks.

Additionally, to ensure secure connection of central pontoon (14) to cabin (12) and to propulsion provided by propeller (22), a tightly drawn securing cable (132) is connected to central pontoon (14) proximal the second extremity (50) and to the cabin (12) proximal the first cabin end (18).

To assist in parting the water and facilitate passage through the water and air, thus increasing speed and aerodynamic efficiency, the central pontoon (14) has generally opposed central pontoon sides (44) which taper curvedly downwardly away from the top portion (36) and towards one another to form the central pontoon edge or blade (46) situated opposite the central pontoon top portion (36).

The central blade (46) and inwardly curving sides (44) assist in parting the water (30) when the central pontoon (14) is situated therein and facilitate passage of the central pontoon (14), and thereby the watercraft 10, through the water. Thus, the central blade (46) and form of central pontoon (14) increase stability and speed, while reducing the amount of power and fuel required.

To further facilitate navigation in water, for the front portion (52) of the central pontoon (14), the sides (44) between the top portion (36) and blade (46) taper laterally inwardly towards one another and the blade (46) slants upwardly to form a point (48) with sides (44) and top portion (36) at the first extremity (48). Thus, the front portion (52) is tapered to the pointed first extremity (48) to better part the water as the central pontoon moves therethrough. The central pontoon (14), including sides (44), blade (46), and top portion (46), may be tapered similarly to the front portion (52) on a rear portion (54) disposed proximal the second extremity (50). A central portion (56) of central pontoon (14) extends between front and rear portions (52, 54) and has less and preferably minimal slanting of the blade (46).

The, preferably hollow, lateral stabilizer pontoons (16) also are buoyant in water.

As with the central pontoon (14), each stabilizer pontoon (16) has opposed stabilizer pontoon sides (58) that curve inwardly from a stabilizer top portion (60) towards one another to form a stabilizer pontoon blade (62) opposite the stabilizer top portion (60) which is connected to the stabilizer connector arms (66).

As with the central blade (46), the stabilizer blades (62) assist in parting water around the stabilizer pontoons (16) to facilitate movement on the water and increase speed, efficiency and fuel economy.

The stabilizer pontoons (16) are pivotally connected by at least one stabilizer connector arm (66) to a respective lateral connector arm (64) which extends laterally, and preferably substantially perpendicularly, outwardly from a central support leg (34), and preferably the upper cylinder (40). Preferably, however, each lateral stabilizer pontoon (16) is pivotally, for example hingedly, connected by a pair of stabilizer connector arms (66) to a pair of lateral connector arms (64) connected to the respective upper cylinders (40) of a pair of central support legs (34), with the lateral connector arms (64) of each pair being preferably in generally co-linear alignment with one another. Thus, the stabilizer pontoons (16) are disposed longitudinally opposite one another and extend generally alongside the central pontoon (14) and cabin (12) in general parallel axial alignment therewith. The cabin (12) and central pontoon (14) are situated, preferably centrally, between the stabilizer pontoons (16). For additional stability, one or more intermediate stabilizer arms (102) may extend, for example diagonally, between and connect the lateral connector arms (64) of each pair.

As each stabilizer connector arm (66), or pair thereof, is pivotally connected to a respective lateral connector arm (64), or pair thereof, the stabilizer connector arms (66) and stabilizer pontoons (16) may be pivoted around axis X to pivotally move the stabilizer pontoons (16) between a raised configuration (68) and a lowered configuration (70). In the raised configuration (68), the stabilizer connector arms (66) are raised and extend substantially parallel the lateral connector arms (64).

The stabilizer pontoons (16) in the raised configuration (68) are raised above the central pontoon (14) and extend, along with stabilizer connector arms (66) generally straight out and substantially parallel to the lateral connector arms (64). In contrast, in the lowered configuration (70), the stabilizer connector arms (66) are pivotally lowered and substantially perpendicular to the lateral connector arms (64). In particular, the stabilizer connector arms (66) and stabilizer pontoons (16) are sized and shaped such that, in the lowered configuration (70), the stabilizer pontoons (16) are lowered and extend alongside the central pontoon (14) in general vertical alignment therewith and with stabilizer blades (62) extending generally parallel, but slightly above, the central blade (46).

In the lowered configuration (70), the stabilizer pontoons (16) generally rest on the surface of the water, with only a small portion thereof, including blades (62), underwater while the central pontoon (16), more substantially submerged, provides the primary flotation of the watercraft (10).

As the stabilizer pontoons (16) in lowered position (70) extend alongside the central pontoon (14), disposed centrally therebetween, the flotation provided by the stabilizer pontoons (16) on either side of the watercraft (10) helps stabilize the watercraft (10) and maintain the watercraft (10) in an upright position, especially useful in rough waters or waves.

The stabilizer blades (62) further ensure that stabilizer pontoons (16) can pass easily through the water in the lowered configuration (70), thus providing stability while minimizing surface drag. Additionally, as the stabilizer pontoons (14) are connected by lateral connector arms (64) to the upper cylinder (40), they are vertically movable in the lowered configuration (70) up and down relative the central pontoon (14) by action of the pneumatic or hydraulic piston (38) and cylinder (40), thus enhancing shock absorption and stability. Additional stability may be achieved by increasing length of the tapered pontoon sides (44, 62), thus increasing the depth into which the blades (46, 62) extend into the water.

Selective pivotal movement of the stabilizer pontoons (16) between configurations (68, 70) is provided by stabilizer pontoon control means, shown generally as (72), accessible from cabin (12) and which selectively pivotally raises and lowers pontoons (16) between configurations (68, 70).

For purposes of example, the control means (72) could include a pivotally mounted lever (74) disposed in the cabin (12), a lever connector cable (90) connecting the lever (74) to a rotatably mounted member or control rod (80), and first and second stabilizer connector cables (82) providing connection between the rod (80) and the stabilizer connector arms (66) for each stabilizer pontoon (14). More specifically, the lever (74) is pivotally mounted in cabin (12) and is pivotally movable back and forth, as shown by arrow D1. Lever connector cable (90) is connected to the lever (74), for example a bottom connector portion (86), and to a fixed position of the rod (80) or an attachment mechanism (88) fixedly attached to rod (80) and extending generally perpendicularly thereto. The rod (80)

is rotatably mounted in the underside of cabin (12) and extends outwardly therefrom generally perpendicularly to the cabin (12) towards the central pontoon (16). The rod (80) defines an axis around which rod (80) is rotatable and has first and second radial arms or members (78*a*, 78*b*) fixedly connected thereto and extending perpendicularly outwardly therefrom from proximal the central pontoon (14), the radial arms (78*a*, 78*b*) extending colinearly with one another and opposite one another from the rod (80) and rotating with the rod (80). The first stabilizer cable (82) is connected to the first radial arm (78*a*) and to one of the stabilizer connector arms (64), or an end bar (84) connecting ends of the pair of stabilizer connector arms (64), for the first stabilizer pontoon (16). The second stabilizer cable (82) is connected to the second radial arm (78*b*) and to one of the stabilizer connector arms (64), or an end bar (84) connecting ends of the pair of stabilizer connector arms (64), for the second stabilizer pontoon (16).

The first and second stabilizer connector cables (82) and lever connector cables (90) cable are sized lengthwise such that when stabilizer pontoons (16) are in the lowered configuration (70), drawn thereto by force of gravity acting on pontoons (16) and stabilizer connector arms (66), the stabilizer connector cables (82) are drawn tightly between the end bars (84) and the radial arms (90) in a first arm position (100). At the same time, the lever (74), connected by lever connector cable (90) drawn tightly to rod (80), is in a first lever position with connector portion (86) extending towards the second cabin end (20). As the connector portion (86) is moved in direction away from the first lever position towards the first cabin end (18), the lever connector cable (90) is pulled with it, causing the rod (80) and radial arms (78*b*) to rotate in direction R1 towards second position (101), pulling the stabilizer connector cable (82) for each stabilizer pontoon (16) towards the opposite stabilizer pontoon (16) and side (30). As the connector cables (82) are already drawn tightly in the lowered configuration (70), the rotation of arms (78*b*) in direction R1 and pulling of cable (82) towards the opposing side (30) causes the end bar (84) to also be drawn towards the opposing side (30) and stabilizer pontoon (16), thus causing the stabilizer connector arms (66) and stabilizer pontoons (16) to pivot upwardly into to the raised configuration (68) when the lever (74) is in the second lever position. When the lever (74) is released from the second position, the action of gravity draws pontoons (16) back towards the lowered configuration (70), causing cables (82) to rotate radial arms (78*a*, 78*b*) and rod (80) in opposite direction R2 and to pull the connector portion (86) of lever (74) via cable (90) back towards the first position. If desired, a retaining mechanism (not shown), for example a box having a plurality of notches for receiving the lever (74) may be deployed to retain the lever (74) in fixed position with the stabilizer pontoons in the raised and lowered configurations (68, 70). Such a retaining mechanism could also have intermediate notches for retaining the lever (74) in intermediate positions between the first and second positions, corresponding to intermediate configurations for the stabilizer pontoons 16 between the raised and lowered configurations (68, 70). Conveniently, intermediate stabilizer arms (102) block end bars (84) when the stabilizer pontoons (16) are in the raised configuration (70), thus preventing the stabilizer pontoons (16) from pivoting upwardly beyond the raised configuration (70).

Steering of the watercraft (10) is provided by upper and lower rudders (104, 106) mounted on pivoting rudder rod (108) pivotally mounted to cabin (12) at second cabin end (20) and to central pontoon (14) at second extremity (48), the rudder rod (108) defining axis Z around which rudders 1(04, 106) may be pivoted.

First and second longitudinally opposed and collinear rudder crossbars (140) are connected to rudder rod (108), generally perpendicular thereto. Upper rudder (104) directs flow of air, whereas lower rudder (106), generally at least partially immersed in water, directs flow of water to provide steering. Steering cable (110) is threaded through aperture (130) in upper rudder (104), through ends of rudder cross bars (140), and connected to corners (112) of a, preferably triangular, steering box or mechanism (114) connected at a central portion thereof to a rotatably mounted steering shaft (118) connected to steering wheel (120). As the steering wheel (120) is turned in direction 51, the shaft (118) and box (114) are rotated causing the steering cable (110) to pull the cross bars (140) and rudder rod (108) in the same direction S1. As the rudder rod (108) is rotated in direction S1, the upper and lower rudders (104, 106) fixedly connected thereto are also pivoted or rotated in direction S1. The increased pressure and/or flow of water and air against the rudders (104, 106) turned in direction S1 causes the watercraft (10) at first end (18) to move in direction S1 of rotation of the steering wheel (120).

Advantageously, the central blades (46) and stabilizer blades (62) are able, via surface tension, to melt a portion of frozen water, i.e. ice, disposed thereunder when the (46, 62) are disposed thereon. Thus, the watercraft (10) may navigate on the blades (46, 62) on ice surfaces in the same way a skater on skates may do so, providing all season functionality for the watercraft (10). As the central pontoons (14, 16) do not need to break the ice, navigation on the ice is facilitated and less fuel and power are required. Once again, rudders (104, 106), and in particular upper rudder (104), provide steering as described above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An air propelled watercraft comprising an elongated cabin structure adapted to accommodate at least one person therein; an elongated central pontoon member adjustably mounted to a bottom portion of the cabin structure and extending in a parallel direction thereto for at least the length thereof; two stabilizer connector assemblies adjustably attached to a bottom portion of the cabin structure and extending horizontally in opposite directions therefrom; two lateral stabilizer pontoons respectively and adjustably attached to a distal end portion of each the stabilizer connector assembly; a motorized propeller attached to one end of the cabin structure; a steering mechanism within the cabin structure including a steering wheel that is mechanically attached to at least one rudder mechanism attached to an end of the cabin structure opposite the and having the propeller; wherein the central pontoon member is adapted to float upon the surface of and extend into a portion of a body of water when the watercraft is in use, and wherein the two lateral stabilizer pontoons are adjustable to be either in contact with the body of water or retracted upwards and away from contacting the body of water when the watercraft is in use, such that the central pontoon member and the two lateral stabilizer pontoons are used to stabilize, control, and aid in the displacement and movement of the watercraft during use;

the elongated central pontoon member is buoyant and includes laterally extending top, side, and bottom portions, wherein the bottom portion includes a central blade extending a portion of its length and functions to increase the stability of the watercraft in water and to provide a sliding surface to the watercraft when the watercraft is placed upon a frozen portion of the body of water;

the side portions of the elongated central pontoon member are tapered along a portion of its length and in a direction from the top portion to bottom portion thereby forming the central blade and increasing the stability and speed of the watercraft.

2. The air propelled watercraft of claim 1, wherein the side portions of the central blade taper towards one another and away from one another in predetermined sections along its length to increase stability and reduce surface drag; and wherein the blade slants upwardly at a front end thereof forming a point with the side and top portions, such that when the watercraft is moving through the body of water, the front end breaks through the water more efficiently and provides further stability to the watercraft.

3. The air propelled watercraft of claim 1, wherein each the stabilizer connector assembly includes a pair of parallel lateral connector arms spaced from one another, and an end bar extending between and connecting distal end portions of each lateral connector arm.

4. The air propelled watercraft of claim 3, wherein each the stabilizer connector assembly further includes at least one intermediate stabilizer arm connected diagonally between the lateral connector arms to further increase the strength thereof.

5. The air propelled watercraft of claim 1, wherein each of the two stabilizer pontoons are pivotally connected to respective the distal end portion of each the stabilizer connector assembly by stabilizer connector arms, to thereby provide for a raised configuration wherein the pontoons are out of the water, and a lowered configuration wherein the pontoons are in the water and are in vertical alignment and slightly vertically above the central blade; and further comprising a stabilizer pontoon control mechanism including a pivotally mounted lever within the cabin structure and adapted to be manipulated by the at least one person; a lever connector cable connecting the lever to a rotatably mounted member, the rotatably mounted member connected to each the stabilizer connector assembly by respective stabilizer cables, such that when the lever is pulled in one direction the stabilizer pontoons are raised out of the water, and when the lever is pulled in an opposite direction the stabilizer pontoons are lowered into the water.

6. The air propelled watercraft of claim 5, wherein the stabilizer pontoon control mechanism further includes retaining box member having a plurality of notches therein, wherein the notches are adapted to receive the lever in one of several positions corresponding to different positions of the stabilizing pontoons and securely hold the stabilizing pontoons in a chosen position.

7. The air propelled watercraft of claim 1, wherein the steering mechanism further includes a second rudder mechanism attached to an end of the central pontoon member residing in proximity to and coinciding with the rudder mechanism on the end of the cabin structure opposite the end having the propeller; wherein the both rudder mechanisms are connected with one another by a rudder rod and respective rudder cross bars, and both controlled in unison by a plurality of steering cables connecting the rudders to a steering shaft and to the steering wheel.

8. The air propelled watercraft of claim 1, further comprising at least one securing cable between the cabin structure and the central pontoon; the at least one securing cable including one securing cable connected between a front portion of the cabin structure and a back portion of the central pontoon.

9. The air propelled watercraft of claim 1, wherein the adjustably mounted connection between the pontoon member and the cabin structure includes three elongated telescoping shock absorber members separated along the length of the central pontoon member.

* * * * *